US005765466A

United States Patent [19]

Plantan et al.

[11] Patent Number: 5,765,466

[45] Date of Patent: Jun. 16, 1998

[54] BRAKE ACTUATOR WITH SELF-CENTERING DIAPHRAM

[75] Inventors: Ronald S. Plantan; Michael M. Holm, both of Carlotte, N.C.

[73] Assignee: Indian Head Industries, Charlotte, N.C.

[21] Appl. No.: 788,691

[22] Filed: Jan. 24, 1997

[51] Int. Cl.[6] ..... F01B 19/00

[52] U.S. Cl. ..... 92/98 R; 92/63; 92/128; 92/99

[58] Field of Search ..... 92/96, 98 R, 99, 92/63, 98 D, 128

[56] References Cited

U.S. PATENT DOCUMENTS

| | | | |
|---|---|---|---|
| 2,744,543 | 5/1956 | Brady, Jr. | 92/98 R |
| 2,886,011 | 5/1959 | Radford . | |
| 3,101,133 | 8/1963 | House et al. . | |
| 3,424,064 | 1/1969 | Valentine . | |
| 3,994,205 | 11/1976 | Ekdahl et al. . | |
| 4,043,251 | 8/1977 | Ohmi . | |
| 4,334,838 | 6/1982 | Fessler et al. | 92/995 |
| 4,391,184 | 7/1983 | Yamane et al. . | |
| 4,960,038 | 10/1990 | Chiba et al. | 92/98 R |
| 5,186,615 | 2/1993 | Karliner | 92/98 R |
| 5,311,809 | 5/1994 | Choinski et al. | 92/63 |
| 5,353,688 | 10/1994 | Pierce et al. | 92/63 |
| 5,477,682 | 12/1995 | Tobiasz . | |
| 5,540,568 | 7/1996 | Rosen et al. | 92/98 R |

*Primary Examiner*—Thomas E. Denion
*Attorney, Agent, or Firm*—Howard & Howard

[57] ABSTRACT

Brake actuators are provided with self-centering diaphragms. In one embodiment, the diaphragm is provided with a centering bead radially outwardly of a sealing bead. The centering bead ensures the diaphragm is properly centered prior to the brake actuator housings being secured together. In a second embodiment, the self-centering structure includes structure fit into mating structure in one of the brake actuator housings to ensure the diaphragm is properly centered. The self-centering structure ensures the brake actuator diaphragms are properly centered before connection of the two brake actuator housings. This invention is particularly useful in the type of brake actuator housings having deformed housing portions.

8 Claims, 3 Drawing Sheets

Fig-3
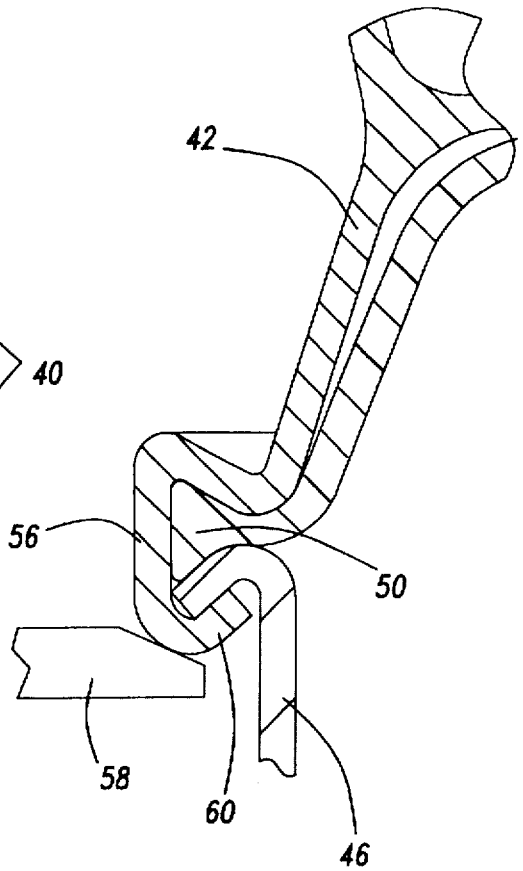
Fig-2C
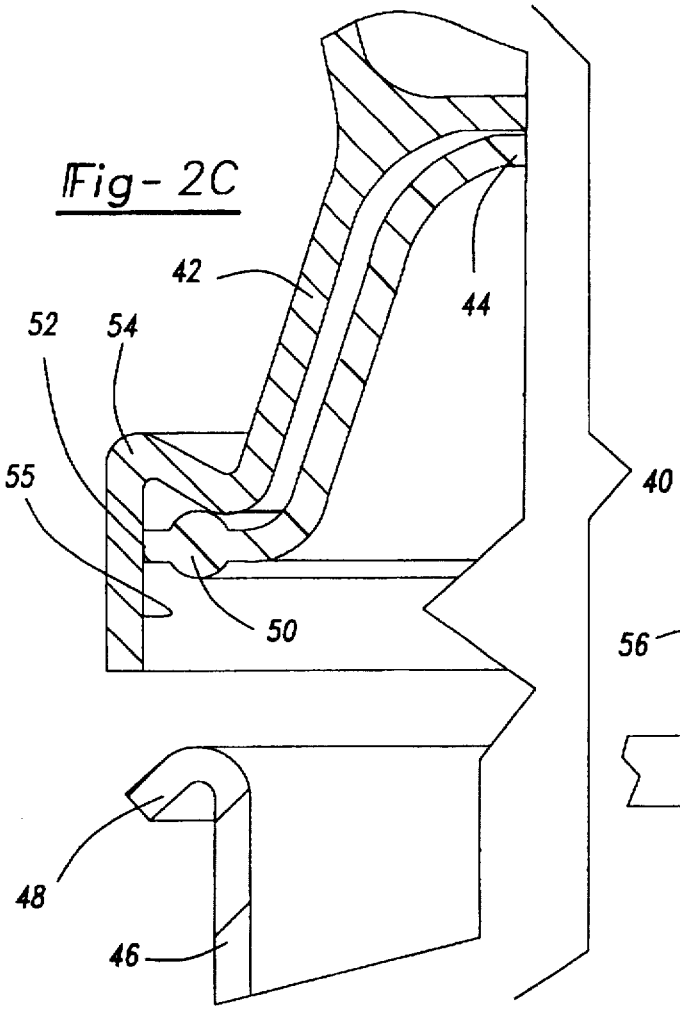
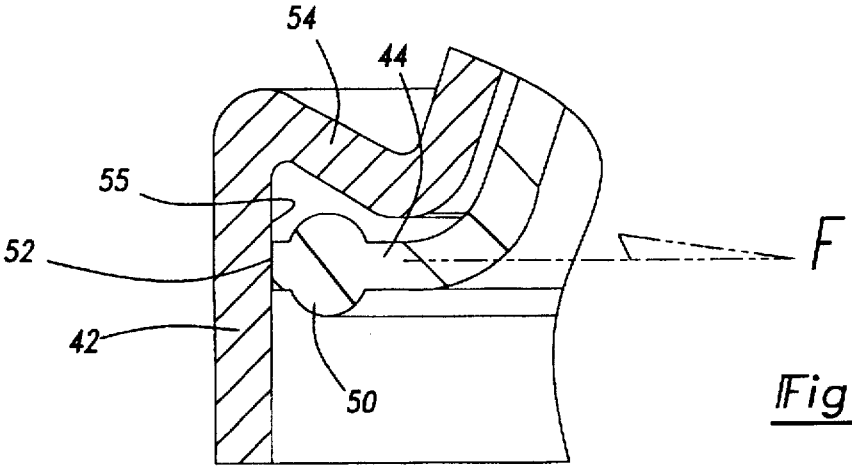
Fig-2B

BRAKE ACTUATOR WITH SELF-CENTERING DIAPHRAM

BACKGROUND OF THE INVENTION

This invention relates to a brake actuator diaphragm which is self-centering prior to securement of the brake actuator chamber housings.

In the prior art, brake actuators are utilized on heavy vehicles to set the brake upon application of air pressure. Typically, a service chamber is provided by two housings which are secured together. A diaphragm is secured between the two housings. Air pressure is selectively introduced on one side of the diaphragm to force a push rod outwardly of the housings, and actuate a brake.

In one type of brake actuator, the service chamber is associated with a parking or emergency chamber. The parking or emergency chamber is provided by a second chamber spaced from the service chamber. The second chamber is typically provided by a third housing secured to an intermediate housing, which also defines the service chamber.

When air pressure fails, a power spring in the emergency chamber moves the push rod outwardly of the service chamber through a second push rod. One type of emergency chamber is provided with a diaphragm, and air pressure is provided on one side of the diaphragm.

One problem with prior art diaphragm-type brake actuators is that an adequate seal must be provided at an outer peripheral surface of the diaphragm, which is squeezed between the housings. This seal has sometimes been somewhat difficult to obtain since the diaphragm may be positioned off center between the housings. Thus, should the diaphragm be positioned off center when the housings are secured together, an adequate seal may not be provided.

Recently, brake actuator housings have been provided wherein one of the two housings is inelastically deformed to the other. With this type of brake actuator housing, once the deformation occurs, the housings cannot be separated. Thus, when the deformation occurs, if the diaphragm is off center, the diaphragm cannot be adjusted. Rather, the entire brake actuator must typically be discarded.

SUMMARY OF THE INVENTION

In one embodiment of this invention, structure is provided on the diaphragm such that the diaphragm is self-centering when positioned between two brake actuator housings. In this way, the diaphragm will be centered when the two housings are secured together. Most preferably, this invention is utilized in the type of brake actuator wherein one of the two housings is deformed relative to the other.

In one embodiment of this invention, the diaphragm is provided with a sealing bead adjacent its outer surface. A centering structure is provided radially outwardly of the sealing bead. The centering structure is resilient, and preferably formed of the same material as the remainder of the diaphragm, including the sealing bead.

In this embodiment, the diaphragm is preferably inserted into a housing which is to be deformed, prior to the housing being deformed. The housing which is to be deformed is typically provided with a generally cylindrical housing portion, which is the portion which is to be deformed. The diaphragm centering portion is preferably formed to have a radially outer diameter which is greater than the inner diameter of the cylindrical housing portion. Thus, when the diaphragm is placed within the cylindrical housing portion, the centering portion is somewhat deformed. The centering portion thus creates a force radially inwardly. Should the diaphragm be initially positioned off center, a portion of the centering portion is compressed even more, and expands to ensure that the diaphragm is quickly and surely centered within the cylindrical housing portion. That is, if the diaphragm is off center by even a slight amount, the portion of the centering portion which is positioned closer to the cylindrical housing portion is deformed to a greater extent than opposed positions. Thus, a force from that portion is greater than an opposed force from the portion of the centering portion positioned on the opposed side of the brake actuator. The centering portion then quickly centers the diaphragm within the cylindrical housing portion.

The housing may then be deformed to the other housing member. Due to the properly centered diaphragm, a good diaphragm seal is ensured.

In a second embodiment, the diaphragm is provided with a centering portion positioned radially inwardly of the sealing bead. The centering portion fits into a mating centering surface within a centering housing. The diaphragm is positioned within the centering housing, and the other housing member is then attached to the centering housing. The centering portion again ensures that the diaphragm is properly positioned within the housing, and that an adequate seal will be provided once the two housing members are secured together. With this embodiment it is preferred that the housing that does not receive the diaphragm is deformed around the housing which does receive the diaphragm.

The first embodiment, is disclosed for use on a diaphragm in a separate, or stand-alone, service chamber. The second embodiment is disclosed for use in an emergency chamber of a brake actuator. It should be understood that either embodiment could be utilized in either chamber or any type of brake actuator.

These and other features of the present invention can be best understood from the following specification and drawings, of which the following is a brief description.

BRIEF DESCRIPTION OF THE DRAWINGS

FIG. 2B shows an off-center diaphragm.

FIG. 2C shows the benefit of the instant invention in recentering the diaphragm.

FIG. 3 shows the FIG. 2 embodiment fully secured.

DETAILED DESCRIPTION OF A PREFERRED EMBODIMENT

Figure 1:
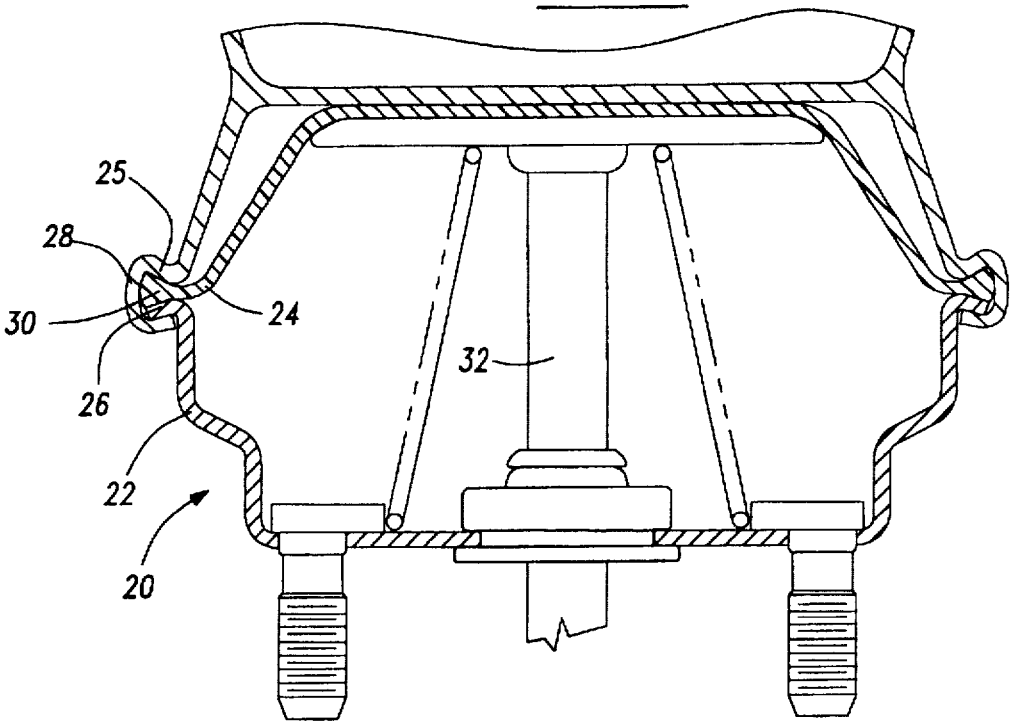
Fig- 1 Prior Art
FIG. 1 shows a known brake actuator somewhat schematically.

FIG. 1 shows a brake actuator 20 as is known in the art. A service chamber housing 22 is provided with a diaphragm 24 and secured to a housing 25. Housing 25 may be an upper housing of the service chamber, or a central housing of the dual chamber brake actuator. Both type brake actuators are known in the art.

As shown, service chamber housing 22 has an outwardly extending flange 26. A portion 28 of the housing 25 is deformed around the flange 26, again as is known in the art.

A radially outer bead 30 from the diaphragm 24 is captured between the housing 25 and the flange 26 to provide a seal. Pressurized air is provided on one side of the diaphragm, and the seal provided by bead 30 must be adequate around the entire circumference of the diaphragm 24, or the brake actuator will leak and not operate properly. A push rod 32 extends through the housing 22 and is connected to a brake as is known.

As described above, the above described brake actuators sometimes leak due to off-center diaphragms. The present invention is directed to ensuring an adequate seal at the outer periphery of the diaphragm.

Figure 2A:
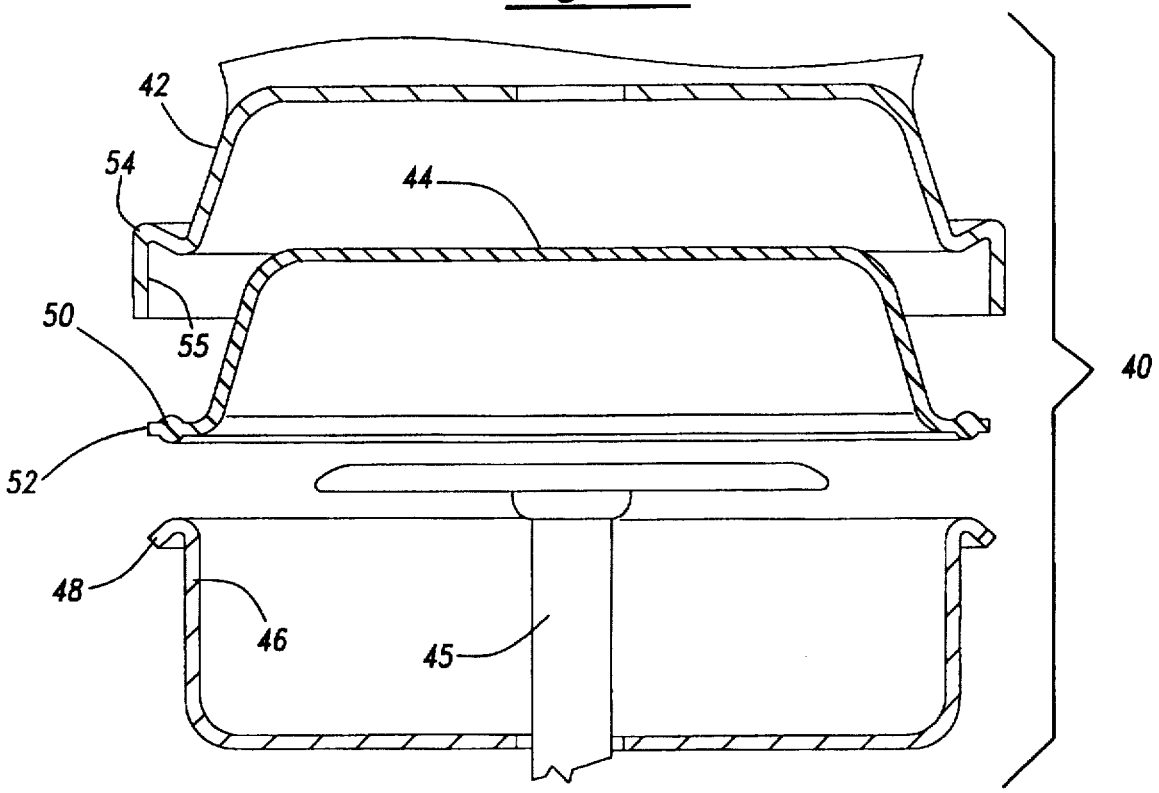
FIG. 2A shows a first step in assembling a brake actuator service chamber.

As shown in FIG. 2A, in one embodiment 40, a stand-alone service chamber includes an upper service chamber housing 42, a diaphragm 44 and a service chamber housing 46. Service chamber housing 46 is provided with a radially outwardly extending flange 48. A sealing bead 50 is provided on diaphragm 44, and an outer centering bead 52 is provided radially outwardly of sealing bead 50. Centering bead 52 and sealing bead 50 are formed of the same resilient material as known diaphragms. A portion 54 to be deformed extends from the upper service chamber housing 42, and provides a generally cylindrical housing portion 55. A push rod 45 extends through the service chamber housing 46.

FIG. 2B shows the inventive centering feature of the present invention. As shown in FIG. 2B, diaphragm 54 has been inserted upwardly into the cylindrical centering portion 55 of the deformed portion 54 of the upper service chamber housing 42. The diaphragm 44 has been positioned off center and to the left as shown in FIG. 2B. Thus, the centering bead 52 is more compressed than the portion at the opposed right-hand side of the diaphragm 54 (not illustrated). This creates a force "F" tending to center diaphragm 54, or move it towards the right. The centering bead 52 thus ensures that the diaphragm 44 is self-centering within the cylindrical portion 55. Preferably, the outer peripheral surface of the centering bead 52 is selected such that it has an outer diameter greater than the inner diameter of cylindrical housing portion 55. At the same time, the inner diameter of the cylindrical housing portion 55 is selected to be greater than the outer diameter of the sealing bead 50. This will ensure that the diaphragm will center itself within the cylindrical portion 55, and back to the position such as shown in FIG. 2C.

As shown in FIG. 2C, an initial step in securing the housing members 42 and 46 together is to position self-centering diaphragm 44 within the cylindrical housing portion 55 of the upper service chamber housing 42. The diaphragm is centered as described above.

A deforming tool 58, then deforms the portion 54 as shown at 56 in FIG. 3. The tool 58 bends the axially outermost end 60 radially inwardly to secure the housing members 42 and 46 together. The centered bead 50 is adequately deformed around the entire circumference of the connection between the two housing members. An adequate seal is thus provided.

Figure 4A:
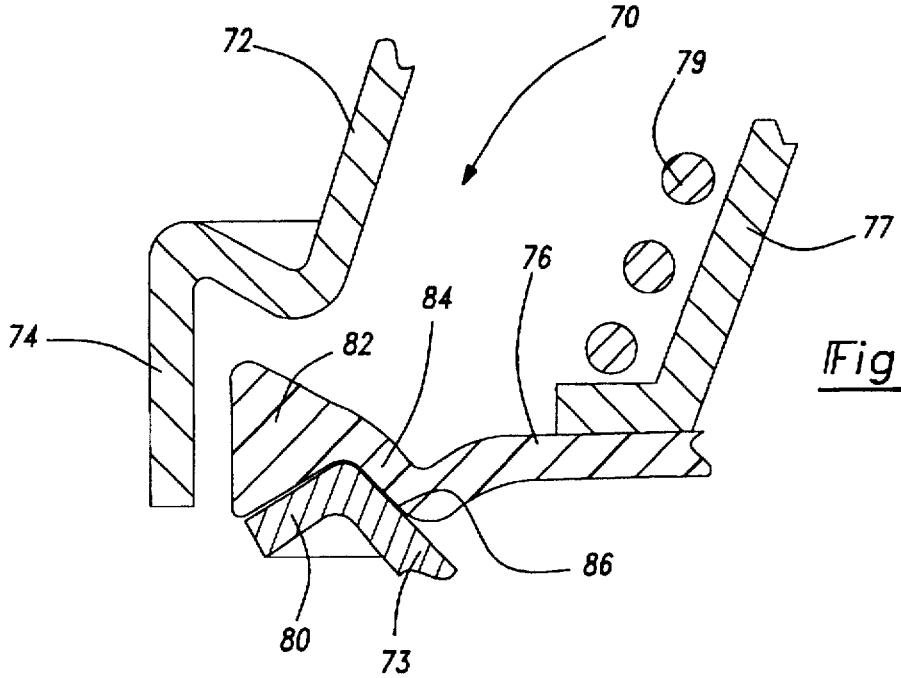
FIG. 4A shows a second embodiment in a first step.

FIG. 4A shows a second embodiment 70. A brake head 72 of a dual-diaphragm brake actuator is secured to a center housing 73. Brake head 72 is provided with a portion 74 which is to be deformed to the central housing 73. A diaphragm 76 is captured between the housings 72 and 73. A spring piston 77 and a power spring 79 are received on one side of the diaphragm 76, as known. The central housing 73 typically has a flange 80 receiving the sealing bead 82 of the diaphragm 76. In this embodiment, the diaphragm 76 has a generally frustro-conical centering portion 84 received within a mating frustro-conical portion 86 of the central housing 83. The outer peripheral diameter of centering portion 84 is somewhat greater than the inner diameter of housing portion 86 to provide a centering force as with the above embodiments. The diaphragm is centered within housing 73 by centering portion 84. An initial step in assembling the brake 70 is to insert the diaphragm 76 within the central housing 73. Portion 74 may then be deformed.

Figure 4B:
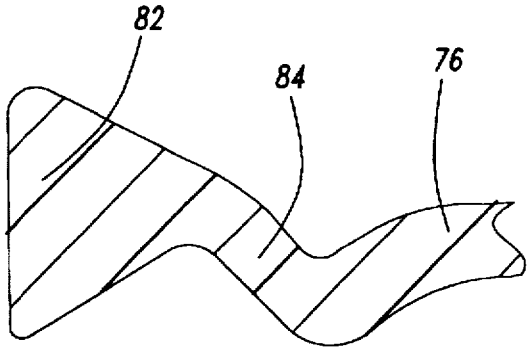
FIG. 4B shows a diaphragm according to the second embodiment.

As shown in FIG. 4B, centering portion 84 positioned radially inwardly of the sealing bead 82. Again, as with the prior embodiment, portions 82 and 84 are formed of the same resilient material as known brake actuator diaphragms.

Figure 5:
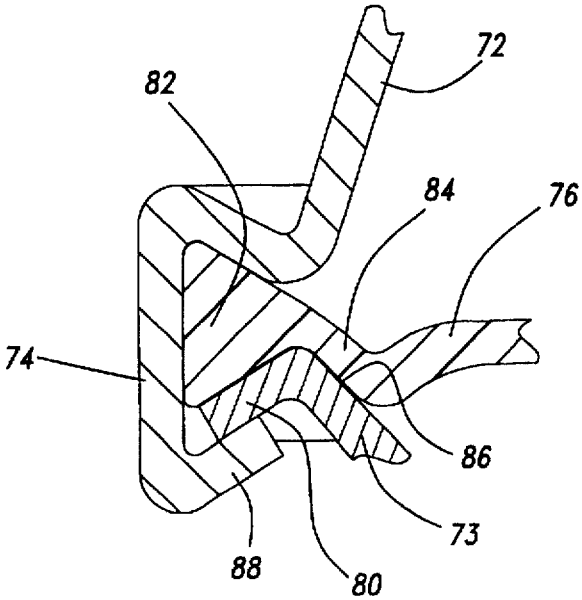
FIG. 5 shows a portion of the final assembled second embodiment brake actuator.

As shown in FIG. 5, the portion 74 has now been deformed radially inwardly at 88 to capture the flange 80, and secure the housings 72 and 73 together. Since centering portion 84 is received within the central housing 73, the diaphragm 76 is properly positioned prior to the deformation, and it is ensured that an adequate seal is provided by the bead 82 around the entire circumference of the diaphragm. The centering portion 84 may remain against housing 73 during operation of brake 70, with flexing of the diaphragm occurring radially inwardly of portion 84. Alternatively, flexing could occur between bead 82 and portion 84 during operation. Once the housings are secured together, centering portion 84 is not necessary, and this can flex away from housing 73 during operation without moving the diaphragm off-center.

Preferred embodiments of this invention have been disclosed, however, a worker of ordinary skill in the art would recognize that certain modifications would come within the scope of this invention. For that reason the following claims should be studied to determine the true scope and content of this invention.

We claim:

1. A brake actuator comprising:

a first housing having a radially outer surface;

a second housing also having a radially outer surface;

a diaphragm having a radially outer sealing bead captured between said radially outer surfaces of said first and second housings, said diaphragm having structure to ensure said diaphragm is centered about the entire periphery of said radially outer surfaces of said first and second housings; and said self-centering structure including a centering bead positioned radially outwardly of said sealing bead, said centering bead being formed of resilient material, said centering bead being of a smaller thickness than said sealing bead in an undeformed condition, said first housing being inelastically deformed to said second housing, said first housing including a cylindrical housing portion prior to being inelastically deformed, said centering bead being sized to have an outer diameter greater than an inner diameter of said centering housing portion, such that said centering bead serves to center said diaphragm within said cylindrical housing portion prior to inelastic deformation, and said sealing bead having an outer diameter which is less than said diameter of said cylindrical housing portion in said undeformed condition.

2. A brake actuator as recited in claim 1, wherein said diaphragm is positioned in said first housing, which is a service chamber housing for a brake actuator, and a push rod is positioned on one side of said diaphragm and extends outwardly through said second housing.

3. A brake actuator as recited in claim 1, wherein said diaphragm is received in said second housing, and said first housing is deformed.

4. A brake actuator comprising:

a first housing having a radially outer surface;

a second housing also having a radially outer surface;

a diaphragm having a radially outer sealing bead captured between said radially outer surfaces of said first and second housings, said diaphragm having structure to ensure said diaphragm is centered about the entire periphery of said radially outer surfaces of said first and second housings, said first housing being inelastically deformed to said second housing; and said diaphragm is provided with a centering portion positioned radially inwardly of said sealing bead, said centering portion corresponding to structure within said second housing to center said diaphragm prior to said first housing being deformed to said second housing, said structure within said second housing including a portion of said housing extending from said radially outer surface of said second housing and away from said first housing, said centering portion including a permanently deformed section of said diaphragm to be received within said structure of said second housing and having an outer diameter greater than the inner diameter of said structure of said second housing such that said centering portion serving to center said diaphragm within said structure, and said centering portion being inward of said radially outer surfaces and said deformed portion of said first housing.

5. A brake actuator as recited in claim 4, wherein said diaphragm is received in an emergency chamber of a dual-diaphragm spring brake actuator.

6. A method of manufacturing a brake actuator comprising the steps of:

(1) providing a first housing having a portion to be deformed and a radially outer surface;

(2) providing a second housing and a second radially outer surface;

(3) providing a diaphragm having a radially outer sealing bead to be received between said radially outer surfaces of said first and second housings, said diaphragm also being providing with a centering portion, said centering portion corresponding to structure within said second housing, said structure within said second housing including a portion of said housing extending from said radially outer surface in a direction away from said first housing, said centering portion including a permanently deformed section of said diaphragm to be received within said structure of said second housing and having an outer diameter greater than the inner diameter of said structure of said second housing such that said centering portion serves to center said diaphragm within said structure;

(4) positioning said diaphragm within said second housing, said centering portion ensuring said diaphragm is centered within said one of said first and second housings; and (5) deforming said deformed portion to secure said first and second housings together, and capture said diaphragm between said first and second housings, said centering portion ensuring said diaphragm is properly centered during said deformation, said centering portion being inward of said radially outer surface and said deformed portion of said first housing.

7. A method of forming a brake actuator comprising the steps of:

(1) providing a first housing having a portion to be deformed including a generally cylindrical housing portion and a radially outer surface;

(2) providing a second housing, with a radially outer surface;

(3) providing a diaphragm having a sealing bead at a generally radially outer position, and a centering bead positioned radially outwardly of said sealing bead, said centering bead having an outer diameter which is greater than the inner diameter of said generally cylindrical housing portion; said sealing bead having an outer diameter which is less than said inner diameter of said generally cylindrical housing portion, said centering bead having a thickness greater than the thickness of said sealing bead;

(4) positioning said centering bead and said diaphragm within said cylindrical housing portion of said first housing; and (5) securing said first and second housings together by deforming said cylindrical housing portion, said centering bead ensuring said diaphragm is properly centered between said radially outer surfaces of said first and second housings during and after said deformation.

8. A method as recited in claim 7, wherein a push rod is positioned on one side of said diaphragm and extends through a hole in one of said first and second housings prior to said deformation of step (5).

* * * * *